US006945213B2

(12) United States Patent
Kawakubo et al.

(10) Patent No.: US 6,945,213 B2
(45) Date of Patent: Sep. 20, 2005

(54) CYLINDER BLOCK FOR MULTICYLINDER ENGINE

(75) Inventors: Hiroyuki Kawakubo, Wako (JP); Tetsuya Nakayasu, Wako (JP); Tadashi Kato, Wako (JP); Nobuyuki Oya, Wako (JP); Tatsuya Hirata, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/227,485

(22) Filed: Aug. 26, 2002

(65) Prior Publication Data

US 2003/0041834 A1 Mar. 6, 2003

(30) Foreign Application Priority Data

Aug. 31, 2001 (JP) ..... 2001-264494

(51) Int. Cl.[7] ..... F02F 1/00
(52) U.S. Cl. ..... 123/195 R
(58) Field of Search ..... 123/195 R, 195 CP, 123/198 P

(56) References Cited

U.S. PATENT DOCUMENTS 4,922,870 A * 5/1990 Pietsch et al. ..... 123/195 R
5,253,615 A * 10/1993 Heater et al. ..... 123/195 R
5,800,902 A * 9/1998 Shimmell et al. ..... 123/198 P
5,829,406 A * 11/1998 Mazzola et al. ..... 123/195 R
6,076,494 A * 6/2000 Kampichler et al. .... 123/195 R
6,244,238 B1 * 6/2001 Takahashi et al. ..... 123/195 R
6,543,405 B2 * 4/2003 Sachdev et al. ..... 123/195 R

FOREIGN PATENT DOCUMENTS

| | | | | |
|---|---|---|---|---|
| JP | 09 133044 | | 5/1997 | |
| JP | 10 220286 | | 8/1998 | |
| JP | 11182326 | A | 7/1999 | |
| JP | 11182326 | * | 7/1999 | ..... F02F/1/00 |
| JP | 11 223118 | | 8/1999 | |
| JP | 2001 003807 | | 1/2001 | |

* cited by examiner

*Primary Examiner*—Henry C. Yuen
*Assistant Examiner*—Jason Benton
(74) *Attorney, Agent, or Firm*—Birch, Stewart, Kolasch & Birch, LLP

(57) ABSTRACT

A cylinder block of a multicylinder engine, having a cylinder main body in which multiple cylinder bores are provided in parallel in an axial direction of a crankshaft, and a crankcase having plural journal walls. The crankcase is integrally provided with the cylinder main body, in which a communication hole extending in parallel to the axial line of the crankshaft is provided in the cylinder main body and the crankcase while at least a part of which is opened in the inner peripheral surface of the cylinder bore. This permits the cylinder block to be downsized, increases freedom of positional setting of the communication hole, and reduces ventilation resistance of air flow through the communication hole. A cut-processed member is expanded further outward from a piston slide surface and is formed along a radial direction of cylinder bores, in inner surfaces of the cylinder bores in at least portions closer to a piston at an open edge of a communication hole.

24 Claims, 7 Drawing Sheets

CYLINDER BLOCK FOR MULTICYLINDER ENGINE

CROSS-REFERENCE TO RELATED APPLICATION

The present application claims priority under 35 U.S.C. §119 to Japanese Patent Application No. 2001-264494, filed Aug. 31, 2001, the entire contents of which are hereby incorporated by reference.

BACKGROUND OF THE INVENTION

1. Field of the Invention

The present invention relates to a cylinder block for a multicylinder engine and more particularly, to a cylinder block for a multicylinder engine having a cylinder main body in which multiple cylinder bores, each having a piston slide surface to slide a piston in an inner periphery, are provided in parallel in an axial direction to a crankshaft and a crankcase. The crankcase has multiple journal walls rotatably supporting at least a part of the crankshaft, integrally provided with the cylinder main body. Communication holes extending in parallel in the axial line of the crankshaft are provided in the cylinder main body and the crank case, while at least a part of the communication holes are opened in the inner peripheries of the cylinder bores.

2. Description of Background Art

Conventionally, such a cylinder block is already known, e.g., in Japanese Published Unexamined Patent Application No. Hei 11-182326.

Conventionally known is a structure where a communication hole connecting adjacent crankcases is provided in a cylinder block to prevent increase in pumping loss due to increase in pressure in the crankcase upon down movement of piston. A burr, which cannot be removed by honing process to form a piston slide surface in an inner surface of a cylinder bore, may occur at an open edge of the communication hole.

For this reason, in the above conventional art, the distance between the burr which occurs in the open edge of the communication hole and an oil ring at a lower end of the piston at the bottom dead center is set to 3 mm or longer. This configuration is set so as to prevent the increase in slide resistance by contact between the oil ring at the lower end of the piston and the burr at the open edge of the communication hole.

However, in the above-described dimensional setting, downsizing of the cylinder block is limited in a direction along the axial line of the cylinder bore, and freedom of positional setting of the communication hole is narrowed. Further, as the burr remains at the open edge of the communication hole, ventilation resistance of air flow through the communication hole increases. To sufficiently reduce the pumping loss, it is necessary to reduce the ventilation resistance of the air flow through the communication hole.

The present invention has been made in view of such situation. The present invention has its object providing of a cylinder block of a multicylinder engine which enables downsizing of cylinder block, increases freedom of positional setting of the communication hole, and reduces ventilation resistance of air flow through the communication hole.

SUMMARY AND OBJECTS OF THE INVENTION

To attain the above object, the first aspect of the present invention provides a cylinder block of a multicylinder engine, having a cylinder main body in which a multicylinder bores each having a piston slide surface to slide a piston in an inner periphery are provided in parallel in an axial direction of a crankshaft, and a crankcase. The crankcase has plural journal walls rotatably supporting at least a half part of said crankshaft, integrally provided with said cylinder main body, in which communication holes extending in parallel to the axial line of said crankshaft are provided in said cylinder main body and the crank case while at least a part of the communication holes are opened in the inner peripheries of said cylinder bores. In addition, cut-processed members expanded further outward from said piston slide surface are formed along a radial direction of the cylinder bores, in an inner surface of said cylinder bores in at least a portion closer to said piston at an open edge of said communication holes.

According to the first aspect of the present invention, even if a burr has occurred at the open edge of the communication hole in at least a portion closer to the piston, the burr is removed by formation of the cut-processed member, and the piston at the bottom dead center can be set in a position closer to the axial line of the communication hole. Accordingly, the cylinder block can be downsized in the direction along the axial line of the cylinder bore, and the freedom of positional setting of the communication hole can be increased. Further, since the burr that previously may have increased the ventilation resistance of air flow between the cylinder bore and the communication hole is removed, the pumping loss can be reduced.

Further, in a second aspect of the present invention, a large-diameter hole having a diameter greater than an inner diameter of said piston slide surface is formed at an end on the crankcase side of said cylinder bores. Further, the cut-processed member is formed to have a bent semicircular cross-sectional shape with a radius approximately the same as a radius of said large-diameter hole in a plane orthogonal to an axial line of said cylinder bores. The large-diameter hole is formed in order to provide clearance for a machine tool for honing of the piston slide surface. According to this construction, once the large-diameter hole is formed, the cut-processed member can be easily made. Further, as the large-diameter hole has approximately the same radius as that of the cut-processed member, the amount of movement of the machining tool along the radial direction of the cylinder bore upon machining of the large-diameter hole and the amount of movement of the machining tool along said radial direction upon machining of the cut-processed member can be set to an equal amount. As a result, the machining of the large-diameter hole and the cut-processed member can be performed easily.

In a third aspect of the present invention, the large-diameter hole and the cut-processed member are formed serially in the axial direction of the cylinder bores. According to the construction, upon machining of the large-diameter hole, the cut-processed member can be formed in a portion corresponding to the communication hole by moving the machining tool in the axial direction of the cylinder bore. As such, the machining can be performed easily.

In a fourth aspect of the present invention, the cut-processed member as a slope intersecting said piston slide surface and the inner surface of said communication holes is formed in the inner surface of said cylinder bores in a portion closer to said piston at the open edge of said communication holes. As a result, the air flow between the cylinder bore and the communication hole is guided by the cut-processed member as a slope. Thus, the ventilation resistance of the air flow can be further reduced, and the pumping loss can be further efficiently reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
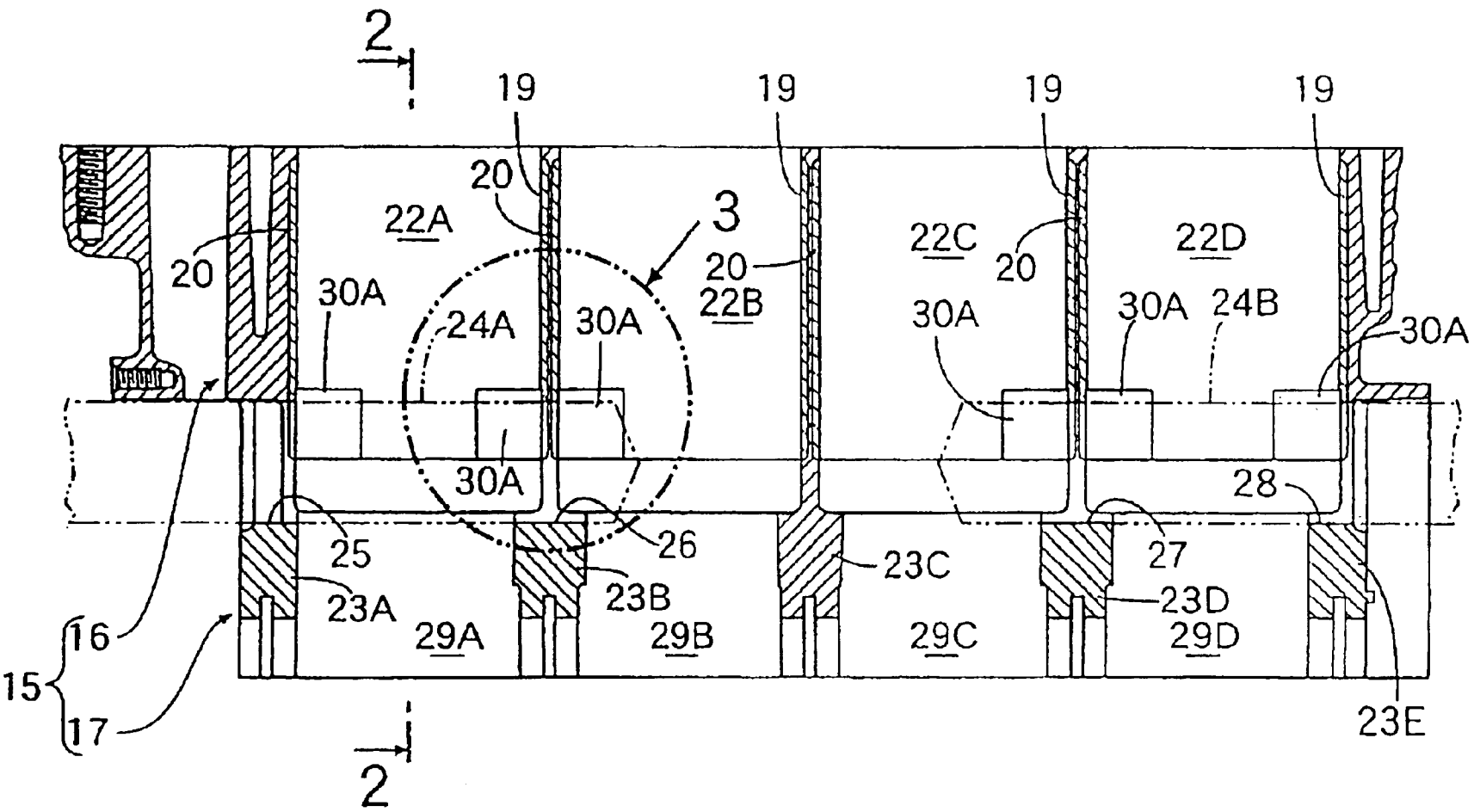
FIG. 1 is a longitudinal sectional view of the cylinder block according to the first embodiment.
Figure 2:
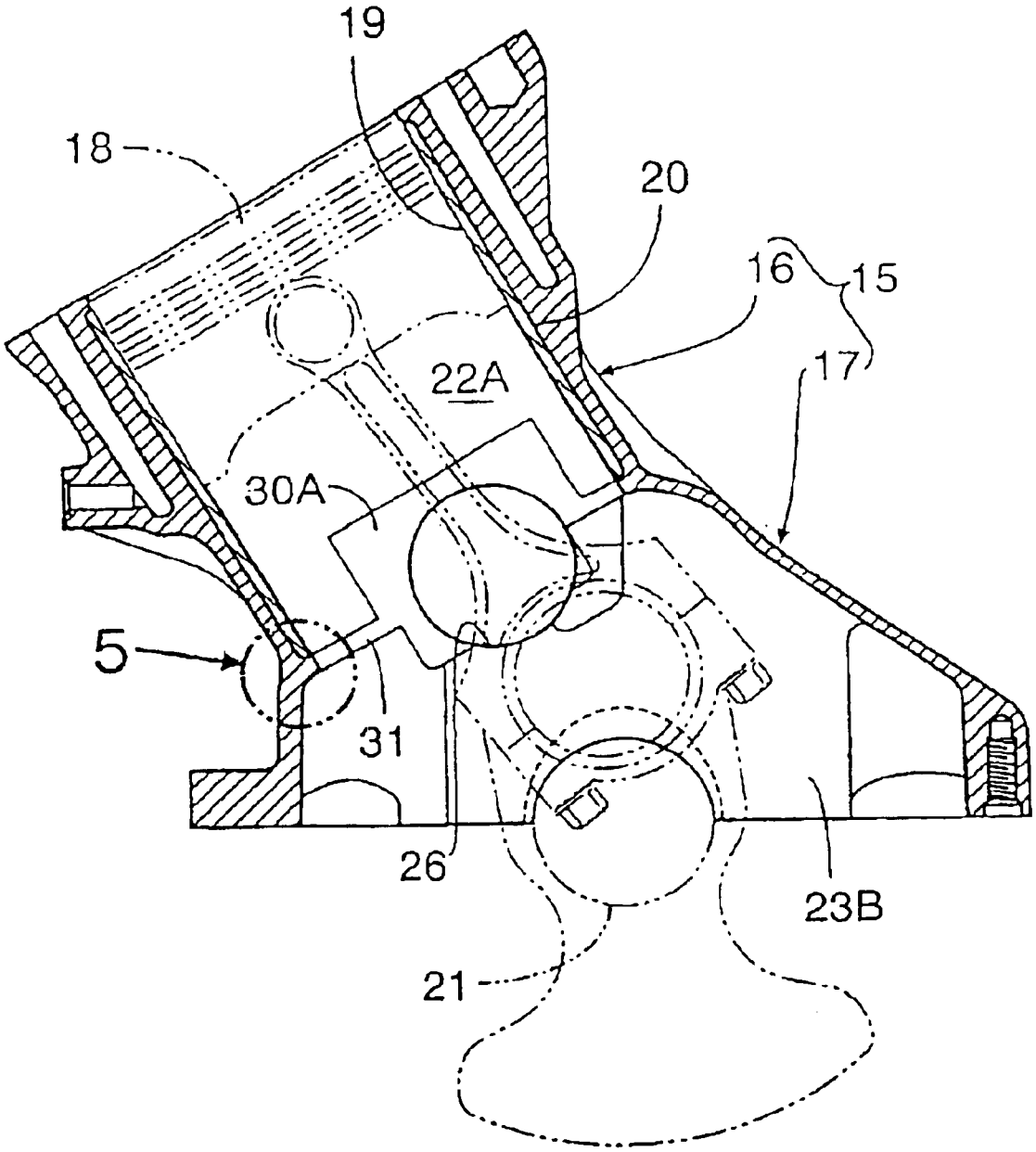
FIG. 2 is a cross-sectional view along the line 2—2 in FIG. 1.

First, in FIGS. 1 and 2, an engine cylinder block 15 having multiple cylinders, e.g., 4 cylinders, includes an integrated cylinder main body 16 and crankcase 17, molded of aluminum alloy or the like.

In the cylinder main body 16, multiple, e.g. four, cylindrical sleeves 20 . . . forming piston slide surfaces 19 . . . to slide pistons 18 . . . in inner peripheral surfaces are embedded at intervals in a direction along an axial line of a crankshaft 21 connecting the respective pistons 18 . . . . First to fourth cylinder bores 22A, 22B, 22C and 22D having large parts of the inner peripheral surfaces as the piston slide surfaces 19 . . . are provided in parallel in the axial line of the crankshaft 21 in the cylinder main body 16.

The crankcase 17 having multiple, e.g. 5, first to fifth journal walls 23A, 23B, 23C, 23D and 23E, is integrally formed with the cylinder main body 16. The first to fifth journal walls 23A to 23E, which rotatably support an upper half part of the crank shaft 21 on both sides of the first to fourth cylinder bores 22A to 22D, are integrally provided with the cylinder main body 16 between the first to fourth cylinder bores 22A to 22D.

Communication holes 25 and 26, having an axial line parallel to the axial line of the crankshaft 21 and at least a part (upper half part in this embodiment) opened in inner peripheries of the first and second cylinder bores 22A and 22B, are formed by boring with a boring tool 24A from the first journal wall 23A side, in a connection portion between the first and second journal walls 23A, 23B and the cylinder main body 16.

Further, communication holes 27 and 28, having an axial line parallel to the axial line of the crankshaft 21 and at least a part (upper half part in this embodiment) opened in inner peripheries of the third and fourth cylinder bores 22C and 22D, are formed by boring with a boring tool 24B from the fifth journal wall 23E side, in a connection portion between the fourth and fifth journal walls 23D, 23E and the cylinder main body 16.

The communication hole 26 between the first and second cylinder bores 22A and 22B connects a crankcase 29A between the first and second journal walls 23A and 23B with a crankcase 29B between the second and third journal walls 23B and 23C. This prevents an increase in pumping loss due to increase in pressure on one side of the both crankcases 29A and 29B upon downward movement of the piston 18 on the one side of the both crankcases 29A and 29B.

In a similar manner, the communication hole 27 between the third and fourth cylinder bores 22C and 22D connects a crankcase 29C between the third and fourth journal walls 23C and 23D with a crankcase 29D between the fourth and fifth journal walls 23D and 23E. This, prevents an increase in pumping loss due to increase in pressure on one side of the both crankcases 29C and 29D upon downward movement of the piston 18 on the one side of the both crankcases 29C and 29D.

Further, the communication hole 25 occurs by boring of the communication hole 26 by the boring tool 24A, and the communication hole 28 occurs by boring of the communication hole 27 by the boring tool 24B. However, since covers (not-shown) are attached to both ends of the cylinder block 15 along the axial line of the crankshaft 21, the communication holes 25 and 28 are closed with those covers.

Figure 3:
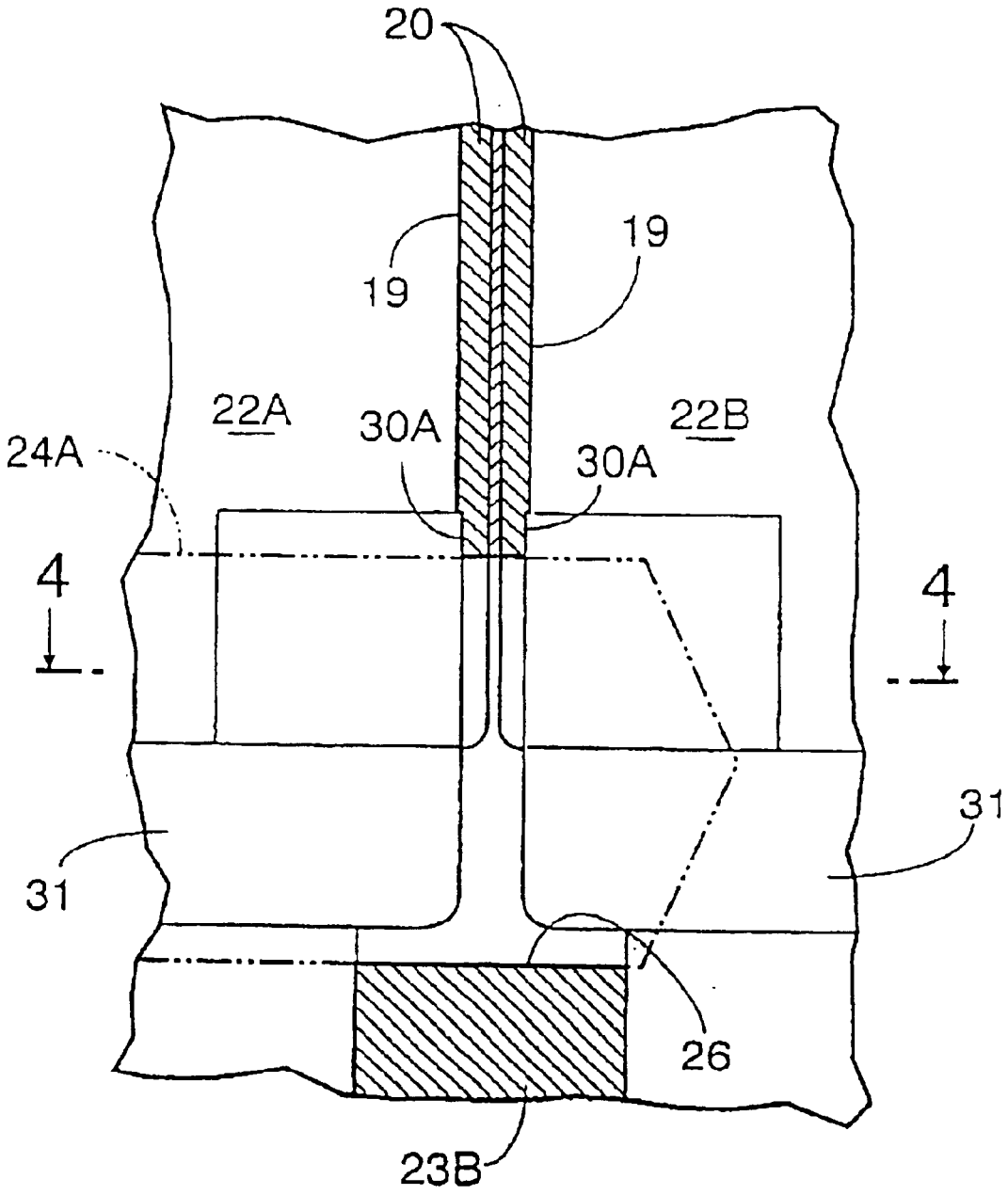
FIG. 3 is an enlarged view of the part 3 in FIG. 1.
Figure 4:
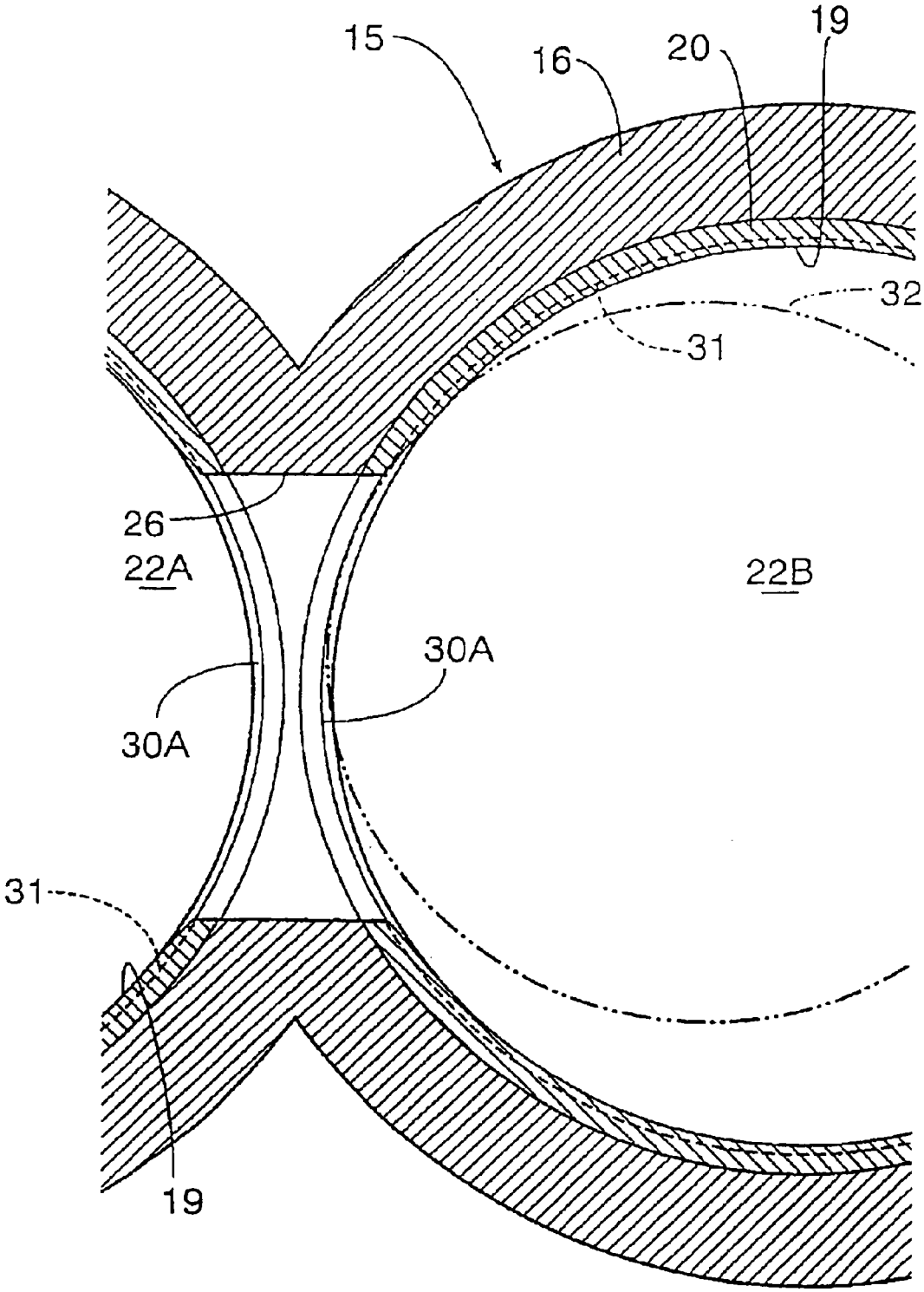
FIG. 4 is a cross-sectional view along the line 4—4 in FIG. 3.

In FIGS. 3 and 4, cut-processed members 30A, 30A, expanded further outward than the piston slide surfaces 19, 19 along a radial direction of the first and second cylinder bores 22A and 22B are formed in at least portions closer to the piston 18 of open edges at both ends of the communication hole 26, i.e., in upper parts of the open edges and in inner surfaces of the first and second cylinder bores 22A and 22B.

Further, cut-processed members 30A . . . are expanded further outward than the piston slide surfaces 19 . . . along the radial direction of the respective cylinder bores 22A, 22C and 22D. These cut-processed members 30A are formed in at least portions of open edge of the communication hole 25 to the first cylinder bore 22A, an open edge of the communication hole 27 to the third and fourth cylinder bores 22C and 22D, and an open edge of the communication hole 28 to the fourth cylinder bore 22D, closer to the piston 18, in the inner surfaces of the respective cylinder bores 22A, 22C and 22D.

Figure 5:
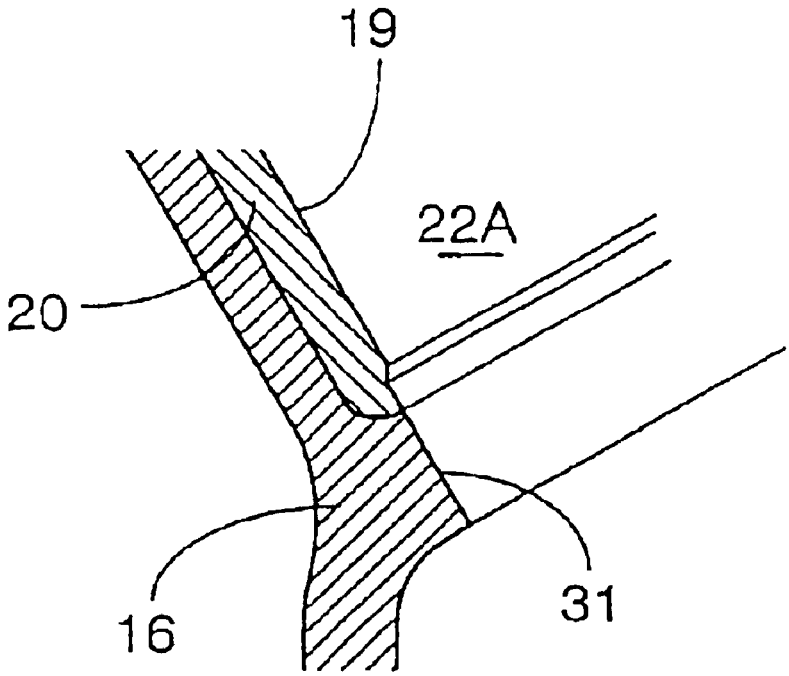
FIG. 5 is an enlarged view of the part 5 in FIG. 2.

Note that the respective piston slide surfaces 19 . . . are formed by a honing process. As shown in FIG. 5, large-diameter holes 31 . . . are formed for the purpose of providing a clearance for honing the piston slides surfaces 19 . . . . The large diameter holes 31 . . . , having diameters greater than an inner diameters of the piston slide surfaces 19 . . . , are formed at ends on the crankcase 17 side of the respective cylinder bores 22A to 22D.

Further, the respective cut-processed members 30A . . . are formed so as to have a bent semicircular cross-sectional shape with a radius approximately the same as a radius of the large-diameter hole 31 . . . in a plane orthogonal to an axial line of the respective cylinder bores 22A to 22D. The respective cut-processed members 30A . . . are formed by a cutter 32 (See FIG. 4) for machining the large-diameter holes 31 . . . .

Further, the respective large-diameter holes 31 . . . and the respective cut-processed members 30A . . . are formed such that they are serially provided along the axial line direction of the respective cylinder bores 22A to 22D.

Next, operations of this first embodiment will be described. The communication holes 25, 26, 27 and 28 expanding in parallel to the axial line of the crankshaft 21 are provided in the cylinder main body 16 and the crank case 17 while at least a part of the communication holes 25 to 28 are opened in the inner peripheries of the first to fourth cylinder bores 22A to 22D. The cut-processed members 30A . . . expanded further outward from the piston slide surfaces 19 . . . are formed along the radial direction of the cylinder bores 22A to 22D, in inner surfaces of the respective cylinder bores 22A to 22D in at least portions closer to the pistons 18 . . . at open edges of the communication holes 25 to 28.

For this reason, in at least portions closer to the pistons 18 . . . at the open edges of the respective communication holes 25 to 28, even if a burr accompanying the machining by the boring tools 24A and 24B has occurred, the burr is removed during the formation of the cut-processed members 30A . . . . In this arrangement, since the pistons 18 . . . at the bottom dead center can be positioned further closer to the axial line of the communication holes 25 to 28, the cylinder block 15 be made smaller in a direction along the axial line of the cylinder bores 22A to 22D. Also, the freedom of positional setting of the communication holes 25 to 28 can be increased.

As described above, communication holes 25 to 26 and communication holes 26 and 27 are provided to reduce the pumping loss associated with the ventilation air flow between the crankcases 29A, 29B and the crankcases 29C, 29D. However, in the present invention, since the burr which otherwise would increase the ventilation resistance has been removed, the pumping loss associated with the air flow between the cylinder bores 22A, 22B and between the cylinder bores 22C, 22D is further reduced.

Further, the large-diameter holes 31 . . . having the diameter greater than the inner diameter of the piston slide surfaces 19 . . . are formed at ends on the crankcase 17 side of the respective cylinder bores 22A to 22D. Also, the cut-processed members 30A . . . are formed to have a bent semicircular cross-sectional shape with a radius approximately the same as a radius of the large-diameter holes 31 . . . in the plane orthogonal to the axial line of the respective cylinder bores 22A to 22D. Accordingly, the cut-processed members 30A . . . can be formed when the large-diameter holes 31 . . . are formed by the cutter 32 as clearances for a machining tool upon honing of the piston slide surfaces 19 . . . , thus machining of the large-diameter holes 31 . . . and the cut-processed members 30A . . . can be easily performed.

Further, as the large-diameter holes 31 . . . and the cut-processed members 30A . . . have approximately the same radius, the amount of movement of the cutter 32 along the radial direction of the cylinder bores 22A to 22D upon machining of the large-diameter holes 31 . . . and the amount of movement of the cutter 32 along the radial direction upon machining of the cut-processed members 30A . . . can be set to an equal amount, and the machining of the large-diameter holes 31 . . . and the cut-processed members 30A . . . can be more easily performed.

Further, as the large-diameter holes 31 . . . and the cut-processed members 30A . . . are serially formed in the axial direction of the cylinder bores 22A to 22D, the cut-processed members 30A . . . can be formed in portions corresponding to the communication holes 25 to 28 upon machining of the large-diameter holes 31 . . . by the cutter 32, by moving the cutter 32 in the axial direction of the cylinder bores 22A to 22D. Thus the machining can be more easily performed.

Note that the large-diameter holes 31 . . . and the cut-processed members 30A . . . are serially formed on the outer side from the piston slide surfaces 19 . . . along the radial direction of the cylinder bores 22A to 22D. As the communication holes 25 to 28 extend in the direction parallel to the axial line of the crankshaft 21 and orthogonal to the axial line of the cylinder bores 22A to 22D, the mutually serially provided large-diameter holes 31 . . . and the cut-processed members 30A . . . do not adversely affect the oscillation phenomenon of the pistons 18 . . . (piston strap).

Figure 6:
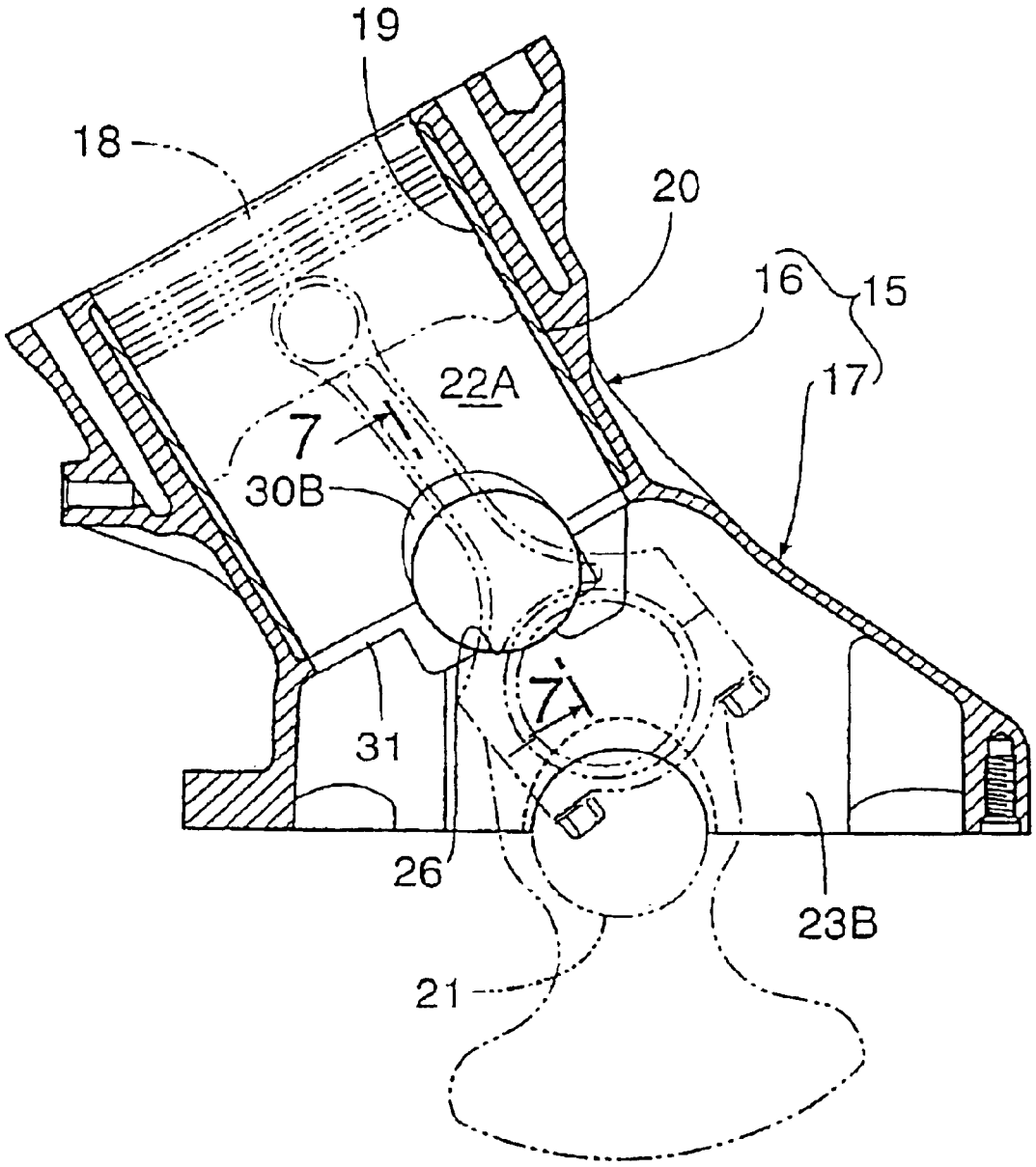
FIG. 6 is a cross-sectional view corresponding to FIG. 2 of the cylinder block according to the second embodiment.
Figure 7:
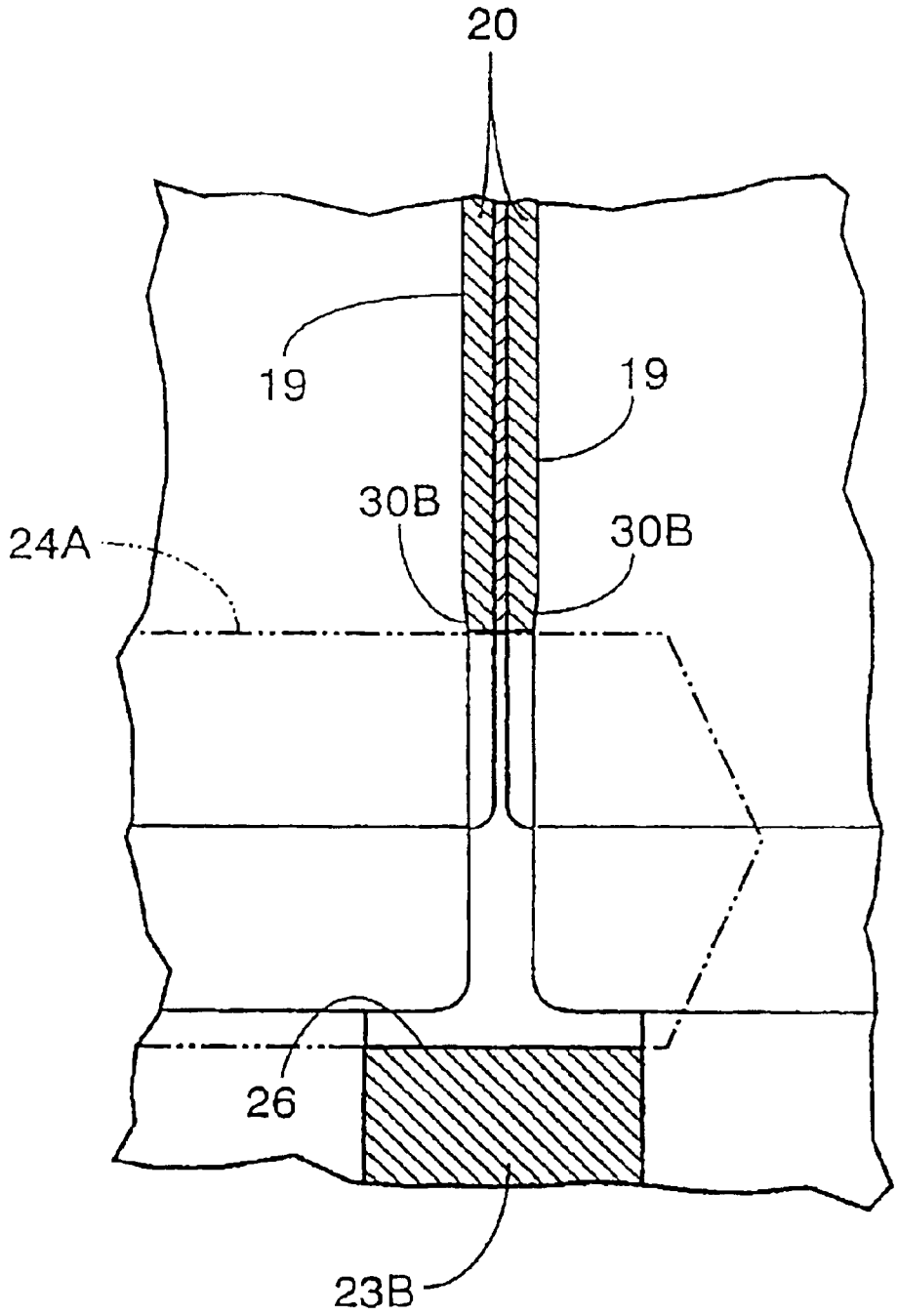
FIG. 7 is an enlarged cross-sectional view along the line 7—7 in FIG. 6.

FIGS. 6 and 7 show a second embodiment of the present invention. FIG. 6 is a cross-sectional view of the cylinder block corresponding to FIG. 2 of the first embodiment; and FIG. 7, an enlarged cross-sectional view along a line 7—7 in FIG. 6.

Cut-processed members 30B, 30B expanded further outward from the piston slide surfaces 19, 19 along the radial direction of the first and second cylinder bores 22A and 22B are formed as slopes intersecting the piston slide surfaces 19 and the inner surface of the communication hole 26 in at least portions closer to the piston 18 at open edges on both ends of the communication hole 26 between the first and second cylinder bores 22A and 22B. In other words, the cut-processed members are formed in upper parts of the open edges and inner surfaces of the first and second cylinder bores 22A and 22B.

Further, regarding the other communication holes 25, 27 and 28 (See the first embodiment in FIGS. 1 to 5), the cut-processed members 30B . . . are formed in the inner surfaces of the respective cylinder bores in portions closer to the pistons 18 . . . at the open edges to the cylinder bores.

According to the second embodiment shown in FIGS. 6 and 7, the air flow between the cylinder bores 22A, 22B and the communication hole 26 is guided by the cut-processed member 30B as a slope. As a result, the ventilation resistance of the air flow is further reduced, and the pumping loss can be more effectively reduced.

Note that inasmuch as the open edge of the communication hole 26 opened in the cylindrical piston slide surface 19 has a three-dimensional curve, the slope cut-processed member 30B cannot be easily formed over the entire periphery of the open edge of the communication hole 26. However, since the cut-processed member 30B is formed in the inner surfaces of the cylinder bores 22A and 22B in the portions closer to the piston 18 at the open edge of the communication hole 26, the slope cut-processed members 30B . . . can be formed without difficult machining.

The embodiments of the present invention have been described as above. The present invention is not limited to the above embodiments, but various design changes can be made without departing from the present invention described in the claims.

Next, the effects of the present invention are summarized.

According to the first aspect of the invention, the cylinder block can be downsized in the direction along the axial direction of the cylinder bores, the freedom of positional setting of the communication hole can be increased, and further, the pumping loss can be reduced.

According to the second and third aspects of the invention, machining of the large-diameter hole and the cut-processed member can be performed easily.

Further, according to the fourth aspect of the invention, the air flow between the cylinder bore and the communication hole is guided by the cut-processed member. As a result, the ventilation resistance of the air flow is reduced, and the pumping loss can be minimized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder block of a multicylinder engine, comprising:

a cylinder main body;

a plurality of cylinder bores provided in said cylinder main body in parallel in an axial direction of a crankshaft, each of said cylinder bores having a piston slide surface to slide a piston in an inner periphery thereof;

a crankcase having a plurality of journal walls rotatably supporting at least a half part of said crankshaft, said crankcase being integrally provided with said cylinder main body;

a plurality of communication holes provided in said cylinder main body and said crank case and extending in parallel to the axial line of said crankshaft while at least a part of one of the plurality of communication holes is opened in an inner periphery of each of said plurality of cylinder bores; and a cut-processed member, said cut-processed member being formed expanding outward from said piston slide surface and along a radial direction of the plurality of cylinder bores and in at least a portion of an inner surface of each of said plurality of cylinder bores in a direction of said piston at an open edge of one of said plurality of communication holes, wherein upper most edges of the plurality of communications holes are below the position where the cut-processed member extends outward from said piston slide surface.

2. The cylinder block of a multicylinder engine according to claim 1, further comprising:

a large-diameter hole having a diameter greater than an inner diameter of said piston slide surface, said large-diameter hole being formed at an end on the crankcase side of said cylinder bores, wherein said cut-processed member is formed to have a bent semicircular cross-sectional shape with a radius approximately the same as a radius of said large-diameter hole in a plane orthogonal to an axial line of said cylinder bores.

3. The cylinder block of a multicylinder engine according to claim 2, wherein said large-diameter hole and said cut-processed member are formed serially in the axial direction in each of the plurality of cylinder bores.

4. The cylinder block of a multicylinder engine according to claim 1, wherein said cut-processed member forms a slope intersecting said piston slide surface and the inner surface of said plurality of communication holes, said cut-processed member being formed in the inner surface of each of said plurality of cylinder bores in a direction of said piston at the open edge of said plurality of communication holes.

5. The cylinder block of a multicylinder engine according to claim 1, wherein the crankcase is formed with one of said plurality of journal walls on each side of each of said plurality of cylinder bores.

6. The cylinder block of a multicylinder engine according to claim 1, wherein the crankcase is formed with crankcase portions, each of said crankcase portions corresponding to one of said plurality of cylinder bores.

7. A cylinder block of a multicylinder engine according to claim 6, wherein said plurality of communication holes provide for ventilation of air between adjacent pairs of said crankcase portions.

8. A cylinder block of a multicylinder engine, comprising:

a cylinder main body in which a plurality of cylinder bores each having a piston slide surface to slide a piston in an inner periphery are provided in parallel in an axial direction of a crankshaft; and a crankcase, having a plurality of journal walls rotatably supporting at least a half part of said crankshaft, said crankcase being integrally provided with said cylinder main body, in which communication holes extending in parallel to the axial line of said crankshaft are provided in said cylinder main body and said crank case while at least a part of the communication holes are opened in the inner peripheries of said cylinder bores, wherein a cut-processed member is formed expanding outward from said piston slide surface and along a radial direction of the cylinder bores and in at least a portion of an inner surface of said cylinder bores in a direction of said piston at an open edge of said communication holes, wherein upper most edges of the plurality of communications holes are below the position where the cut-processed member extends outward from said piston slide surface.

9. The cylinder block of a multicylinder engine according to claim 8, further comprising:

a large-diameter hole having a diameter greater than an inner diameter of said piston slide surface, said large-diameter hole being formed at an end on the crankcase side of said cylinder bores, wherein said cut-processed member is formed to have a bent semicircular cross-sectional shape with a radius approximately the same as a radius of said large-diameter hole in a plane orthogonal to an axial line of said cylinder bores.

10. The cylinder block of a multicylinder engine according to claim 9, wherein said large-diameter hole and said cut-processed member are formed serially in the axial direction of the cylinder bores.

11. The cylinder block of a multicylinder engine according to claim 8, wherein said cut-processed member forms a slope intersecting said piston slide surface and the inner surface of said communication holes, said cut-processed member being formed in the inner surface of said cylinder bores in a direction of said piston at the open edge of said communication holes.

12. The cylinder block of a multicylinder engine according to claim 8, wherein the crankcase is formed with one of said plurality of journal walls on each side of each of said plurality of cylinder bores.

13. The cylinder block of a multicylinder engine according to claim 8, wherein the crankcase is formed with crankcase portions, each of said crankcase portions corresponding to one of said plurality of cylinder bores.

14. A cylinder block of a multicylinder engine according to claim 13, wherein said plurality of communication holes provide for ventilation of air between adjacent pairs of said crankcase portions.

15. A cylinder block of a multicylinder engine, comprising:

a cylinder main body;

a plurality of cylinder bores provided in said cylinder main body in parallel in an axial direction of a crankshaft, each of said cylinder bores having a piston slide surface to slide a piston in an inner periphery thereof;

a crankcase formed with a crankcase portion corresponding to each of said plurality of cylinder bores, said crankcase having a plurality of journal walls rotatably supporting at least a half part of said crankshaft, and said crankcase being integrally provided with said cylinder main body;

a plurality of communication holes provided in said cylinder main body and said crank case and extending in parallel to the axial line of said crankshaft while at least a part of one of the communication holes is opened in an inner periphery of each of said plurality of cylinder bores; and a cut-processed member, said cut-processed member being formed expanding outward from said piston slide surface and along a radial direction of the cylinder bores and in at least a portion of an inner surface of each of said plurality of cylinder bores in a direction of said piston at an open edge of one of said plurality of communication holes, wherein upper most edges of the plurality of communications holes are below the position where the cut-processed member extends outward from said piston slide surface.

16. The cylinder block of a multicylinder engine according to claim 15, further comprising:

a large-diameter hole having a diameter greater than an inner diameter of said piston slide surface, said large-diameter hole being formed at an end on the crankcase side of said cylinder bores, wherein said cut-processed member is formed to have a bent semicircular cross-sectional shape with a radius approximately the same as a radius of said large-diameter hole in a plane orthogonal to an axial line of said cylinder bores.

17. The cylinder block of a multicylinder engine according to claim 16, wherein said large-diameter hole and said cut-processed member are formed serially in the axial direction in each of the plurality of cylinder bores.

18. The cylinder block of a multicylinder engine according to claim 15, wherein said cut-processed member forms a slope intersecting said piston slide surface and the inner surface of said communication holes, said cut-processed member being formed in the inner surface of each of said plurality of cylinder bores in a direction of said piston at the open edge of said communication holes.

19. The cylinder block of a multicylinder engine according to claim 15, wherein the crankcase is formed with one of said plurality of journal walls on each side of each of said plurality of cylinder bores.

20. A cylinder block of a multicylinder engine according to claim 15, wherein said plurality of communication holes provide for ventilation of air between adjacent pairs of said crankcase portions.

21. The cylinder block of a multicylinder engine according to claim 1, wherein said plurality of communication holes provided in said cylinder main body penetrates through all except one of said plurality of journal walls of said crank case.

22. The cylinder block of a multicylinder engine according to claim 21, wherein the journal wall without the one of said plurality communication holes is formed substantially at a middle portion of the cylinder main body.

23. The cylinder block of a multicylinder engine according to claim 1, wherein one of said plurality of communications holes is opened in an outer periphery of each of a first and a last of said plurality of cylinder bores disposed along the axial direction of the crankshaft.

24. The cylinder block of a multicylinder engine according to claim 1, further comprising:

a sleeve in each of the cylinder bores, each of the sleeves having a cylindrical-shaped outer surface without a step, and a cylindrical-shaped inner surface forming the piston slides surfaces, wherein said cut-processed member forms a step in a lower portion of the cylindrical-shaped inner surface of each the sleeves.

* * * * *